US009885368B2

(12) United States Patent
Dygert et al.

(10) Patent No.: US 9,885,368 B2
(45) Date of Patent: Feb. 6, 2018

(54) STALL MARGIN ENHANCEMENT OF AXIAL FAN WITH ROTATING SHROUD

(71) Applicant: Carrier Corporation, Farmington, CT (US)

(72) Inventors: Ryan K. Dygert, Cicero, NY (US); Peter R. Bushnell, Cazenovia, NY (US)

(73) Assignee: CARRIER CORPORATION, Farmington, CT (US)

( * ) Notice: Subject to any disclaimer, the term of this patent is extended or adjusted under 35 U.S.C. 154(b) by 1278 days.

(21) Appl. No.: 13/849,980

(22) Filed: Mar. 25, 2013

(65) Prior Publication Data

US 2013/0315737 A1 Nov. 28, 2013

Related U.S. Application Data

(60) Provisional application No. 61/651,277, filed on May 24, 2012.

(51) Int. Cl.
*F04D 27/02* (2006.01)
*F04D 29/52* (2006.01)
(Continued)

(52) U.S. Cl.
CPC ..... *F04D 29/526* (2013.01); *F04D 29/164* (2013.01); *F04D 29/326* (2013.01); *F04D 29/685* (2013.01)

(58) Field of Classification Search
CPC .... F04D 29/526; F04D 29/326; F04D 29/164; F04D 29/685; F04D 29/4226; F04D 29/4253
(Continued)

(56) References Cited

U.S. PATENT DOCUMENTS 3,479,009 A * 11/1969 Bean ..... F01D 5/323 416/193 A
3,511,577 A * 5/1970 Karstensen ..... F01D 5/08 415/115
(Continued)

FOREIGN PATENT DOCUMENTS

CA 1004143 A 1/1977
DE 102006039007 A1 2/2008
(Continued)

OTHER PUBLICATIONS

Notification of Transmittal of the International Search Report of the International Searching Authority, or the Declaration; PCT/US2013/074054; dated Apr. 28, 2014; 6 Pages.
(Continued)

*Primary Examiner* — Jason Shanske
(74) *Attorney, Agent, or Firm* — Cantor Colburn LLP

(57) ABSTRACT

A fan assembly includes a shrouded fan rotor having fan blades extending from a hub and rotatable about a central axis. A fan shroud extends circumferentially around the fan rotor and secured to the fan blades. The shroud includes a first axially extending annular portion secured to the fan blades, a second axially extending annular portion radially outwardly spaced from the first axially extending annular portion, and a third portion connecting the first and second axially extending annular portions. A casing is located circumferentially around the fan shroud defining a radial clearance between the casing and the fan shroud, and includes casing wedges extending from a radially inboard surface of the casing toward the shroud and defining a radial wedge gap between a first wedge surface and the shroud and an axial wedge gap between a second wedge surface and an upstream end of the fan shroud.

38 Claims, 9 Drawing Sheets

(51) Int. Cl.
*F04D 29/16* (2006.01)
*F04D 29/68* (2006.01)
*F04D 29/32* (2006.01)

(58) Field of Classification Search
USPC ..... 415/58.5, 179; 416/189, 191
See application file for complete search history.

(56) References Cited

U.S. PATENT DOCUMENTS

| | | | | |
|---|---|---|---|---|
| 3,867,060 | A | 2/1975 | Huber | |
| 4,181,172 | A | 1/1980 | Longhouse | |
| 4,863,343 | A | 9/1989 | Smed | |
| 5,065,058 | A | 11/1991 | Ferguson et al. | |
| 5,248,224 | A | 9/1993 | Amr | |
| 5,273,400 | A | 12/1993 | Amr | |
| 5,297,931 | A | 3/1994 | Yapp et al. | |
| 5,308,225 | A | 5/1994 | Koff et al. | |
| 5,431,533 | A | 7/1995 | Hobbs | |
| 5,443,363 | A | 8/1995 | Cho | |
| 5,489,186 | A | 2/1996 | Yapp et al. | |
| 5,525,038 | A | 6/1996 | Sharma et al. | |
| 5,553,999 | A | 9/1996 | Proctor et al. | |
| 5,601,402 | A | 2/1997 | Wakeman et al. | |
| 5,639,210 | A | 6/1997 | Carpenter et al. | |
| 5,641,267 | A | 6/1997 | Proctor et al. | |
| 5,762,034 | A | 6/1998 | Foss | |
| 5,881,685 | A | 3/1999 | Foss et al. | |
| 6,302,640 | B1 | 10/2001 | McKelvey | |
| 6,508,628 | B2 | 1/2003 | Amr | |
| 6,579,063 | B2 | 6/2003 | Stairs et al. | |
| 6,585,479 | B2 | 7/2003 | Torrance | |
| 6,595,744 | B2 | 7/2003 | Van Houten | |
| 6,874,990 | B2 | 4/2005 | Nadeau | |
| 7,086,825 | B2 | 8/2006 | Wang et al. | |
| 7,108,482 | B2 | 9/2006 | Chapman | |
| 7,134,838 | B2 | 11/2006 | Dube et al. | |
| 7,165,937 | B2 | 1/2007 | Dong et al. | |
| 7,182,047 | B1 | 2/2007 | Schwartz | |
| 7,362,017 | B2 | 4/2008 | Piper et al. | |
| 7,396,205 | B2 | 7/2008 | Dube et al. | |
| 7,478,993 | B2 | 1/2009 | Hong et al. | |
| 7,600,965 | B2 * | 10/2009 | Seitz | F01D 11/08 415/144 |
| 7,887,296 | B2 | 2/2011 | Suciu et al. | |
| 7,901,178 | B2 | 3/2011 | Giaimo et al. | |
| 8,105,012 | B2 | 1/2012 | Anema | |
| 2002/0164247 | A1 | 11/2002 | Sylvain et al. | |
| 2006/0140753 | A1 | 6/2006 | Romanov et al. | |
| 2008/0191564 | A1 | 8/2008 | Piper et al. | |
| 2008/0310961 | A1 | 12/2008 | Guemmer | |
| 2009/0004032 | A1 | 1/2009 | Kaupert | |
| 2009/0016877 | A1 | 1/2009 | Schlunke | |
| 2010/0040458 | A1 | 2/2010 | Busnnell | |
| 2010/0068028 | A1 | 3/2010 | Bushnell | |
| 2010/0011166 | A1 | 5/2010 | Stagg et al. | |
| 2010/0284785 | A1 | 11/2010 | Wadia et al. | |
| 2011/0030336 | A1 | 2/2011 | Kuehn et al. | |
| 2011/0070072 | A1 | 3/2011 | Subramaniyan | |
| 2011/0248452 | A1 | 10/2011 | John et al. | |
| 2011/0250064 | A1 | 10/2011 | Neeli et al. | |
| 2015/0354598 | A1 * | 12/2015 | Dygert | F04D 29/164 415/208.2 |

FOREIGN PATENT DOCUMENTS

| | | | | |
|---|---|---|---|---|
| EP | 497574 | A1 | 8/1992 | |
| EP | 0723625 | A1 | 7/1996 | |
| EP | 0820557 | A1 | 1/1998 | |
| EP | 1228317 | A1 | 8/2002 | |
| EP | 1340921 | A2 | 9/2003 | |
| EP | 2302169 | A2 | 3/2011 | |
| EP | 2378077 | A2 | 10/2011 | |
| EP | 2447542 | A2 | 5/2012 | |
| EP | 1443215 | B1 | 10/2013 | |
| GB | 1473719 | A | 5/1977 | |
| JP | 59203898 | A | 11/1984 | |
| JP | 8193599 | A | 7/1996 | |
| JP | 9088892 | A | 3/1997 | |
| JP | 09177694 | | 11/1997 | |
| WO | 1997026450 | A1 | 7/1997 | |
| WO | 2001034983 | A1 | 5/2001 | |
| WO | 2005073559 | A1 | 8/2005 | |
| WO | 2006036511 | A3 | 6/2006 | |
| WO | 2006063825 | A1 | 6/2006 | |
| WO | 2008022739 | A1 | 2/2008 | |
| WO | 2008052292 | A1 | 5/2008 | |
| WO | 2008082397 | A1 | 7/2008 | |
| WO | 2008082428 | A1 | 7/2008 | |
| WO | WO 2008124656 | A1 * | 10/2008 | F04D 17/06 |
| WO | 2008143603 | A1 | 11/2008 | |
| WO | 2011019442 | A1 | 2/2011 | |
| WO | 1995010692 | A1 | 4/2016 | |

OTHER PUBLICATIONS

Written Opinion of the International Searching Authority; PCT/US2013/074054; dated Apr. 28, 2014; 7 Pages.

* cited by examiner

STALL MARGIN ENHANCEMENT OF AXIAL FAN WITH ROTATING SHROUD

CROSS REFERENCE TO RELATED APPLICATION

This application claims priority to U.S. provisional application, 61/651,277, filed May 24, 2012, the entire contents of which are incorporated herein by reference.

BACKGROUND OF THE INVENTION

The subject matter disclosed herein relates to shrouded axial fans. More specifically, the subject matter disclosed herein relates to structure to enhance stall margin of shrouded axial fans.

Axial flow fans are susceptible to leakage flow from the high pressure side to low pressure side of the fan blades, typically a flow from the downstream side of the fan to the upstream side of the fan. The leakage flow occurs at either the fan blade tip, specifically between the tip and the casing in an unshrouded fan, or between the shroud and the casing in the case of a shrouded fan. This leakage flow is reingested into the fan at, for example, a front clearance gap between the shroud and the casing, at a leading edge of the shroud. As the leakage flow reenters the fan, it gives rise to rotating swirl flow and instabilities at the blade tip, often causing the flow at the blade tip to separate and stall prematurely. The result is a generally limited stable operating range for a typical axial flow fan that is limited in its range of applications. Many configurations of "casing treatments" have been developed to address the leakage flow issue, most of which are specifically applicable to unshrouded axial fans or impellers used in high-speed compressor applications, while only a limited number are suitable for use with shrouded fans. In one such case, a number of vanes extend from the interior of the casing toward the shroud to reduce swirl in the recirculating flow.

BRIEF DESCRIPTION OF THE INVENTION

In one embodiment, a fan assembly includes a shrouded fan rotor including a plurality of fan blades rotatable about a central axis of the fan assembly and a fan shroud extending circumferentially around the fan rotor and secured to the plurality of fan blades. The shroud has a substantially S-shaped cross-section along an axial direction. A casing is located circumferentially around the fan shroud defining a radial clearance between the casing and the fan shroud. The casing includes a plurality of casing wedges extending from a radially inboard surface of the casing toward the shroud and defining a radial wedge gap between a first wedge surface and a maximum radius point of the shroud and an axial wedge gap between a second wedge surface and an upstream end of the fan shroud.

In another embodiment, a casing for an axial flow fan includes a casing inner surface extending circumferentially around a central axis of the fan. A plurality of casing wedges extends radially inwardly from the casing inner surface. Each casing wedge includes a first wedge surface defining a radial wedge gap between the first wedge surface and a fan rotor and a second wedge surface defining an axial wedge gap between the second wedge surface and an upstream end of the fan rotor.

In yet another embodiment, a fan assembly includes a shrouded fan rotor having a plurality of fan blades extending from a rotor hub and rotatable about a central axis of the fan assembly. A fan shroud extends circumferentially around the fan rotor and secured to the plurality of fan blades. The shroud includes a first axially extending annular portion secured to the plurality of fan blades, a second axially extending annular portion radially outwardly spaced from the first axially extending annular portion, and a third portion connecting the first and second axially extending annular portions. A casing is located circumferentially around the fan shroud defining a radial clearance between the casing and the fan shroud. The casing includes a plurality of casing wedges extending from a radially inboard surface of the casing toward the shroud and defining a radial wedge gap between a first wedge surface and a maximum radius point of the shroud and an axial wedge gap between a second wedge surface and an upstream end of the fan shroud.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
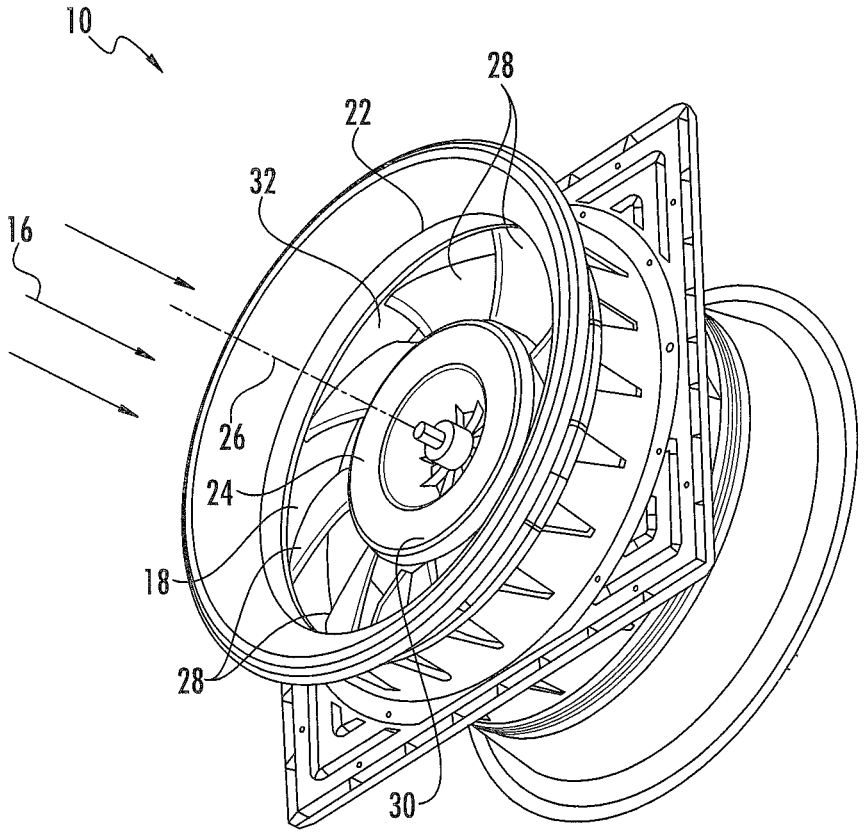
FIG. 1 is a perspective view of an embodiment of a fan assembly.

The detailed description explains embodiments of the invention, together with advantages and features, by way of example with reference to the drawing.

DETAILED DESCRIPTION OF THE INVENTION

Shown in FIG. 1 is an embodiment of an axial-flow fan 10 utilized, for example in a heating, ventilation and air conditioning (HVAC) system. The fan 10 may be driven by an electric motor (not shown) connected to the fan 10 by a shaft, or alternatively a belt or other arrangement. In operation, the motor drives rotation of the fan 10 about a fan axis 26 to urge airflow 16 across the fan 10 and along a flowpath 18, for example, from a heat exchanger (not shown). The fan 10 includes a casing 22 with a fan rotor 24, or impeller rotably located in the casing 22. The fan rotor 24 includes a plurality of fan blades 28 extending from a hub 30 and terminating at a fan shroud 32. The fan shroud 32 is connected to one or more fan blades 28 of the plurality of fan blades 28 and rotates about the fan axis 26 therewith. In some embodiments, the fan 10 further includes a stator (not shown) located either upstream or downstream of the fan rotor 24.

Figure 2:
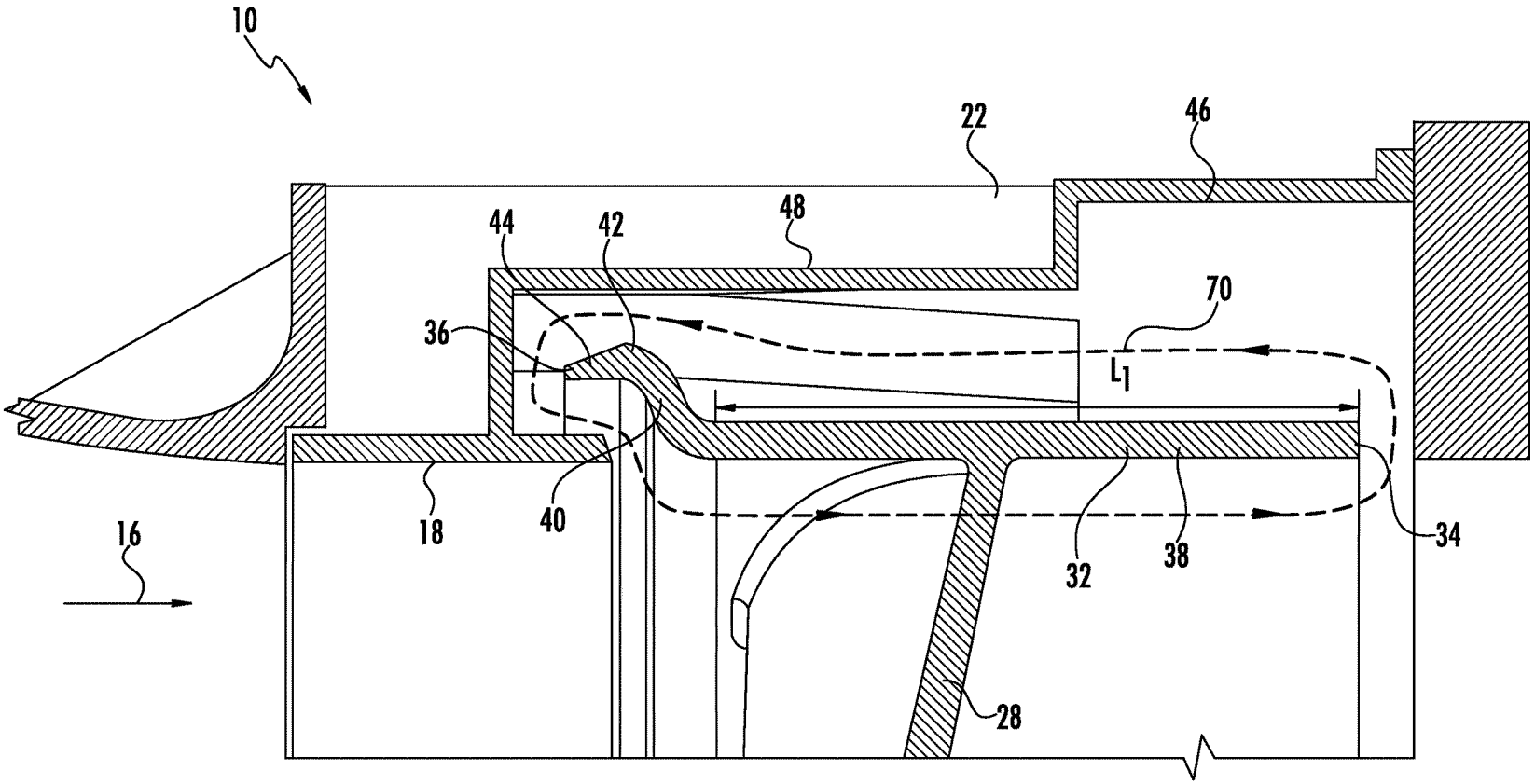
FIG. 2 is a partial cross-sectional view of an embodiment of a fan assembly illustrating a fan shroud and casing interface.
Figure 2A:
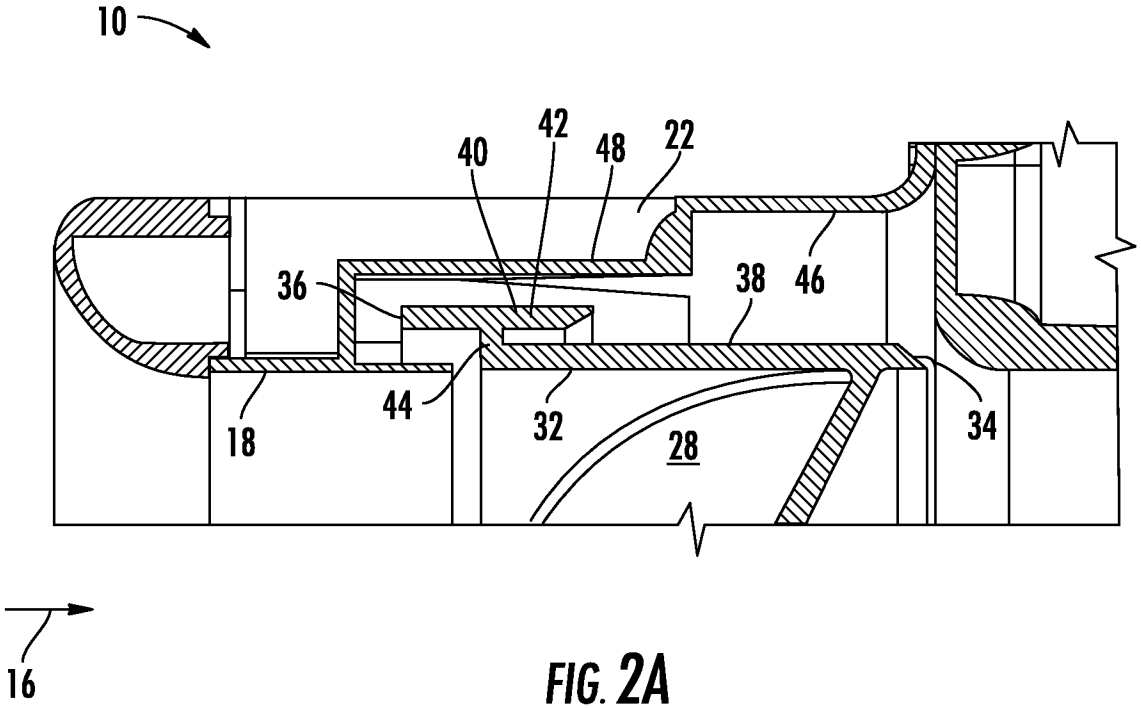
FIG. 2A is a partial cross-sectional view of another embodiment of a fan assembly illustrating a fan shroud and casing interface.
Figure 2B:
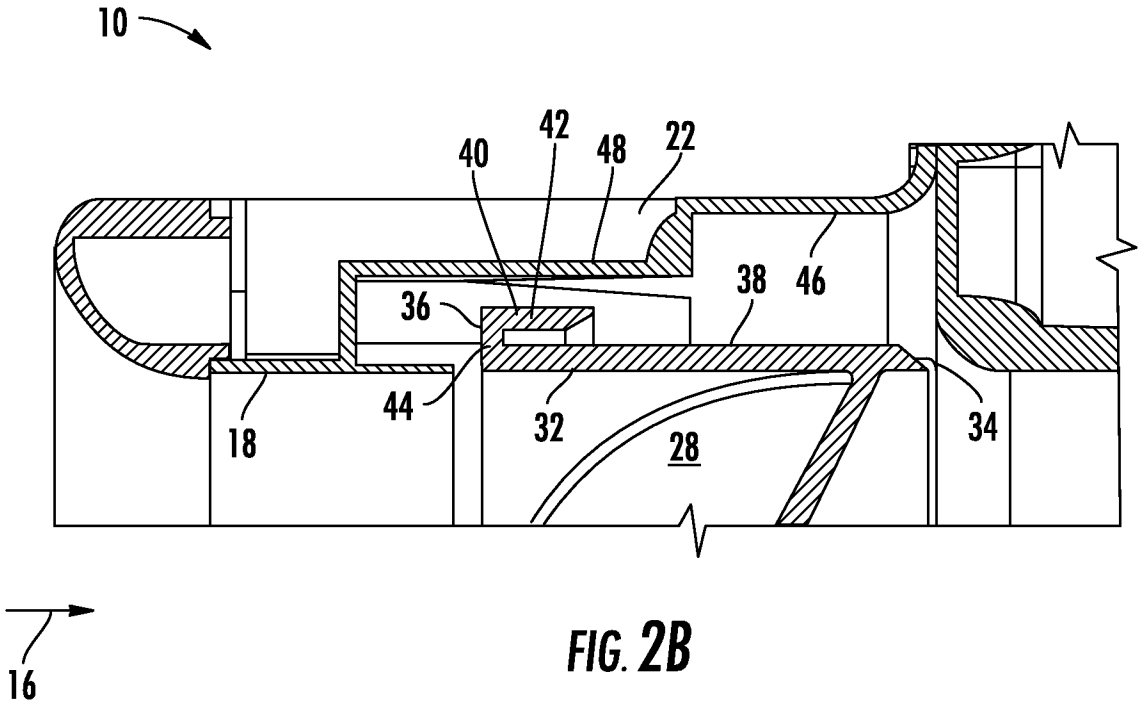
FIG. 2B is a partial cross-sectional view of yet another embodiment of a fan assembly illustrating a fan shroud and casing interface.

Referring to FIG. 2, the fan shroud 32 defines a radial extent of the fan rotor 24, and defines running clearances between the fan rotor 24, in particular the fan shroud 32, and the casing 22. During operation of the fan 10, a recirculation flow 70 is established from a downstream end 34 of the fan shroud 32 toward an upstream end 36 of the fan shroud 32, where at least some of the recirculation flow 70 is reingested into the fan 10 along with airflow 16. This reingestion may be at an undesired angle or mass flow, which can result in fan instability or stall. To alleviate this, the fan shroud 32 extends substantially axially from the downstream end 34 of the fan shroud 32 toward the upstream end 36 of the fan shroud 32 along a first portion 38 for a length $L_1$, which may be a major portion (e.g. 80-90%) of a total shroud length $L_{tot}$. The fan shroud 32 then includes an outwardly flaring second portion 40, which extends from the first portion 38 and transitions from an outwardly concave to an outwardly convex shape at a maximum radius location 42. From the maximum radius location a tapering third portion 44 extends to the upstream end 36. In some embodiments, this results in a substantially s-shaped cross-section of the fan shroud 32. In other embodiments, for example, as shown in FIGS. 2*a*-2*b*, the resulting cross-section is T-shaped and J-shaped, respectively.

The casing 22 includes a casing inner surface 46, which in some embodiments is substantially cylindrical or alternatively a truncated conical shape, extending circumferentially around the fan shroud 32. Further, the casing 22 includes a plurality of casing wedges 48 extending radially inboard from the casing inner surface 46 toward the fan shroud and axially at least partially along a length of the fan shroud 32. The casing wedges 48 may be separate from the casing 22, may be secured to the inner surface 46, or in some embodiments may be formed integral with the casing 22 by, for example, injection molding.

Figure 3:
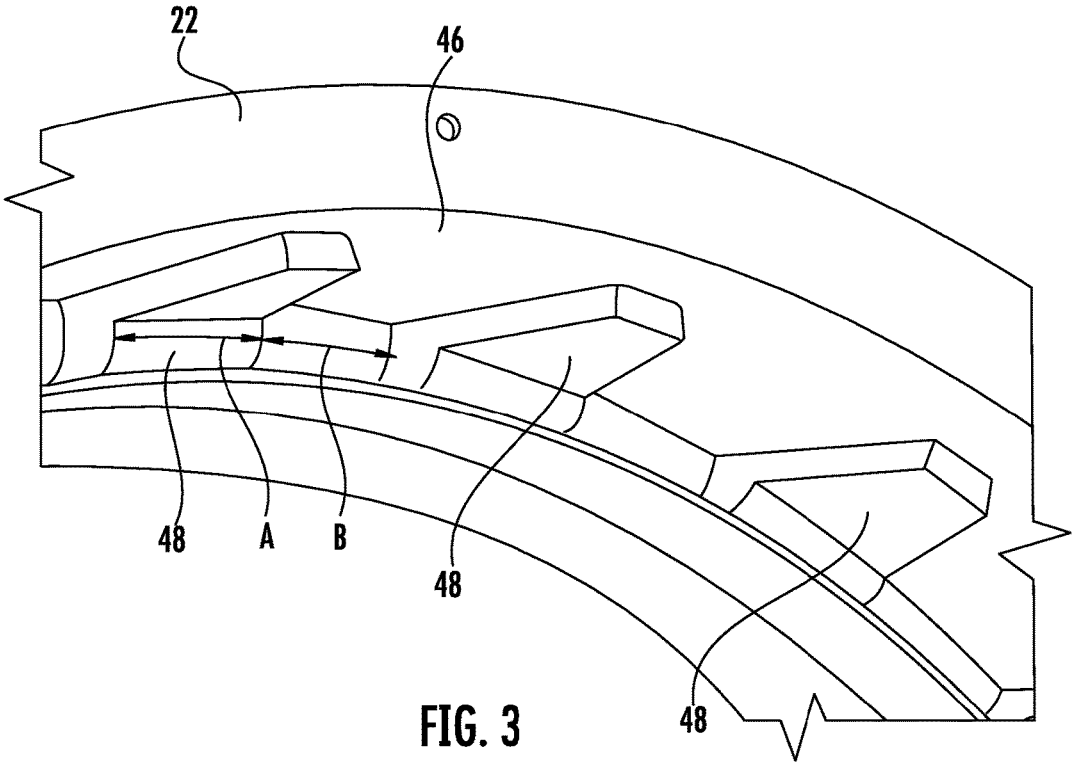
FIG. 3 is a partial cross-sectional view of an embodiment of a casing for a fan assembly.

Referring to FIG. 3, the casing wedges 48 are arrayed about a circumference of the casing 22, and in some embodiments are at equally-spaced intervals about the circumference. The number of casing wedges 48 is variable and depends on a ratio of wedge width A of each wedge to opening width B between adjacent wedges expressed as A/B as well as a ratio of wedge width A to fan shroud 32 circumference, expressed as $A/\pi D$, where D is a maximum diameter of the fan shroud 32. In some embodiments, ratio A/B is between 0.05 and 2, though may be greater or lesser depending on an amount of swirl reduction desired. In some embodiments, ratio $A/\pi D$ is in the range of about 0.002 to 0.2. Further, the number of casing wedges 48 may be selected such as not to be a multiple of the number of fan blades 28 to avoid detrimental tonal noise generation between the recirculation flow 70 emanating from the casing wedges 48 and the rotating fan blades 28. In some embodiments, the fan rotor 24 has 7, 9 or 11 fan blades 28.

Figure 4:
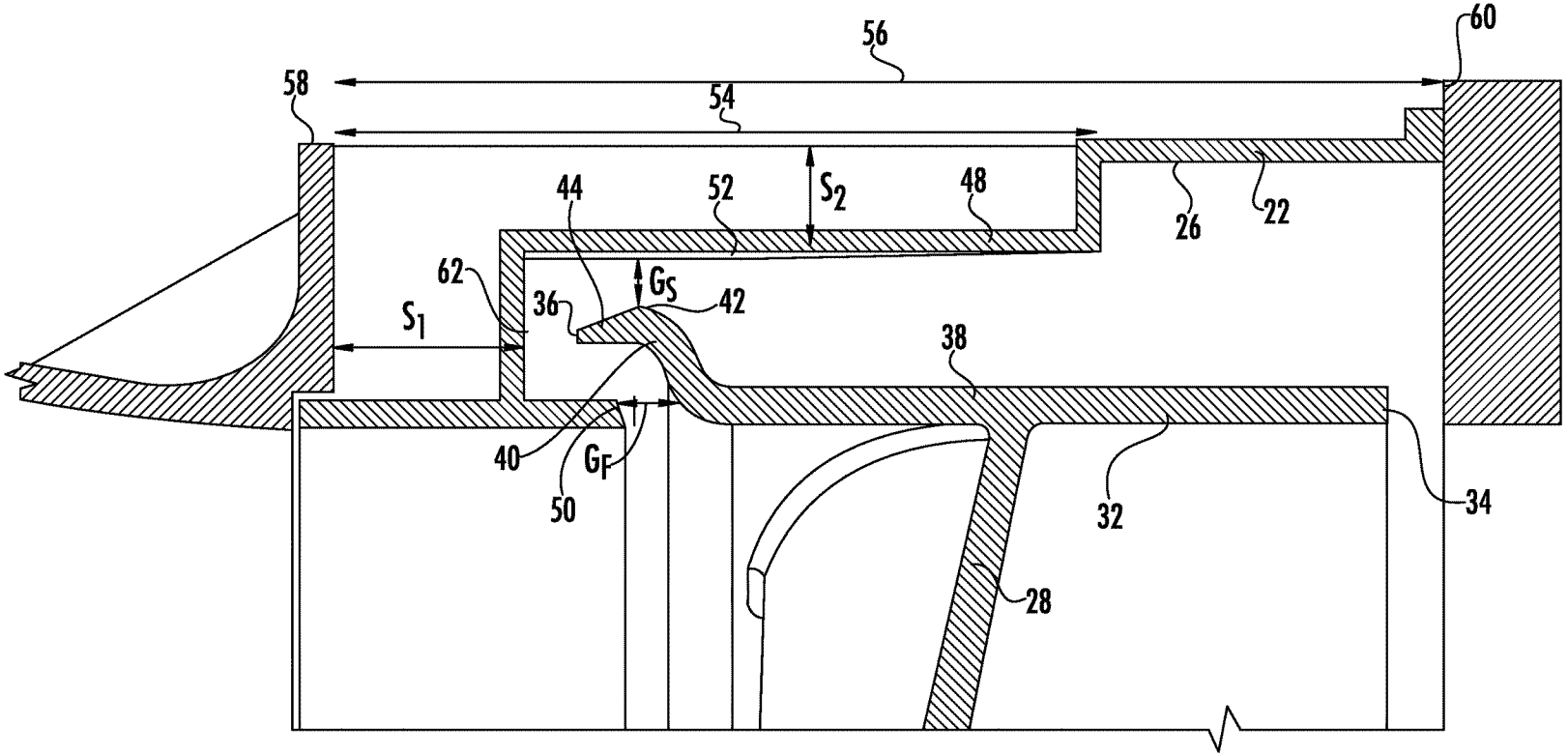
FIG. 4 is another partial cross-sectional view of an embodiment of a fan assembly illustrating a fan shroud and casing interface.

Referring again to FIG. 2, the casing wedges 48 in some embodiments are shaped to conform to and wrap around the S-shaped second portion 40 and third portion 44 of the fan shroud 32, leaving minimum acceptable running clearances between the casing wedges 48 and the fan shroud 32. Thus, as shown in FIG. 4, the casing wedges 48 result in an axial step $S_1$ from a forward end 52 of the casing 22 and a radial step $S_2$ from the casing inner surface 46 at each casing wedge 48 around the circumference of the casing 22. A magnitude of the step $S_1$ is between $1*G_F$ and $20*G_F$, where $G_F$ is an axial offset from a forward flange 50 of the casing 22 to the second portion 40 of the fan shroud 32. Similarly, a magnitude of $S_2$ is between $1*G_S$ and $20*G_S$, where $G_S$ is a radial offset from the maximum radius location 42 to a radially inboard surface 52 of the casing wedge 48. An axial wedge length 54 is between 25% and 100% of an axial casing length 56. Further, the radially inboard surface 52, while shown as a substantially radial surface, may be tapered along the axial direction such that $S_2$ decreases, or increases, along the axial wedge length 54 from an upstream casing end 58 to a downstream casing end 60. A forward wedge surface 62, which defines $S_1$, while shown as a flat axial surface, may be similarly tapered such that $S_1$ decreases, or increases or both, with radial location along the forward wedge surface 62. In other embodiments, forward wedge surface 62 may have a curvilinear cross-section.

Figure 4A:
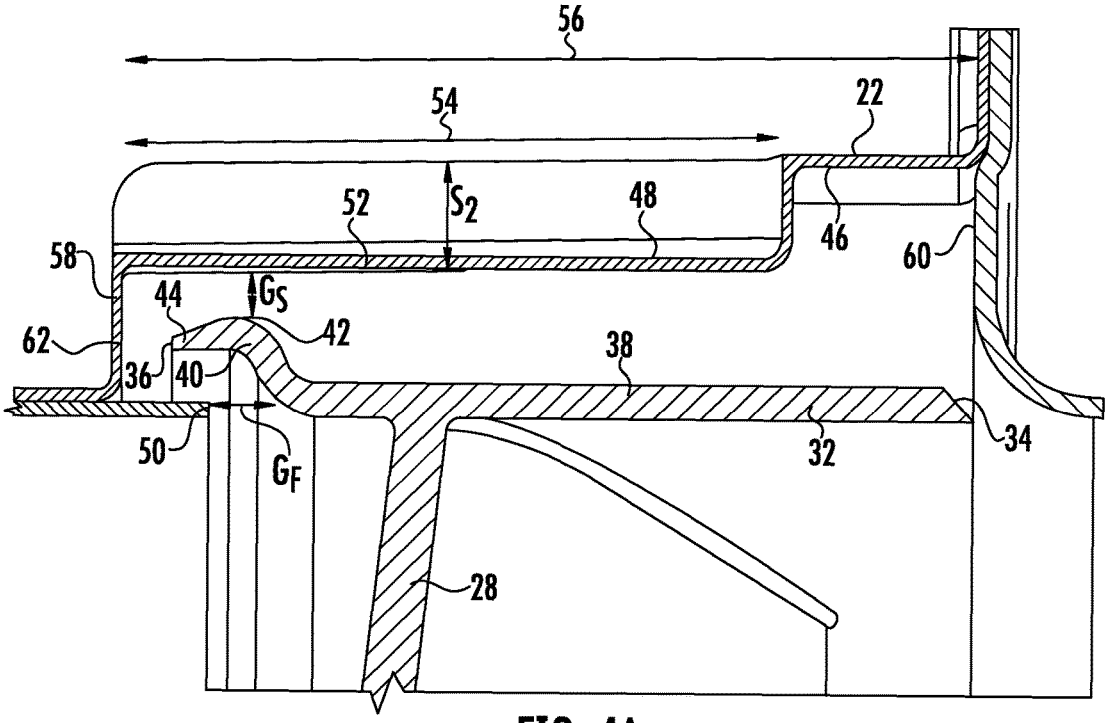
FIG. 4*a* is a partial cross-sectional view of another embodiment fan assembly illustrating a fan shroud and casing interface.

Referring to FIG. 4*a*, the forward wedge surface 62 of some embodiments may coincide with the forward casing surface 58. In such cases, the forward axial step S1 is zero. The forward casing surface 58 may be a constant radial surface or may be a curvilinear surface.

Figure 5:
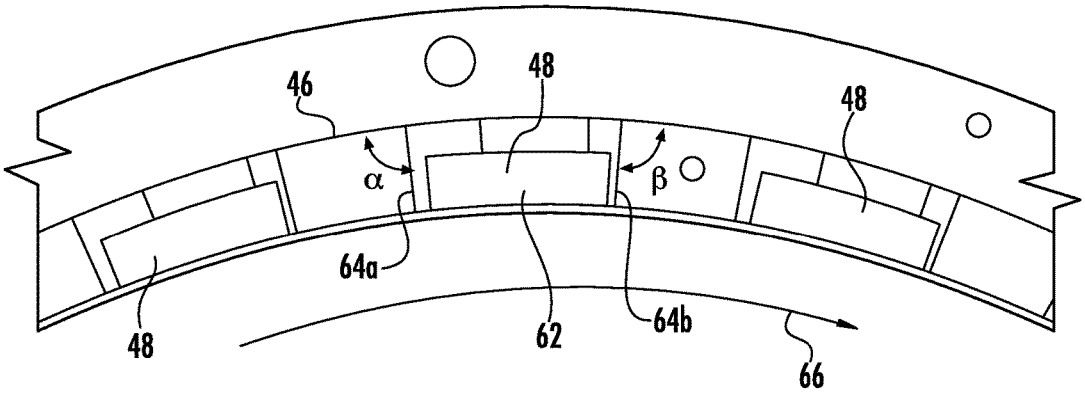
FIG. 5 is another upstream-facing cross-sectional view of an embodiment of a rotor casing illustrating angles formed between casing wedge sides and tangents to the casing.

Referring to FIG. 5, wedge sides 64*a* and 64*b* of the casing wedges 48 form angles α and β, respectively at an intersection with a tangent of the casing inner surface 46, where side 64*a* is a leading side relative to a rotation direction 66 of the fan rotor 24 and 64*b* is a trailing side relative to the rotation direction 66. In some embodiments, α and β are in the range of 30° and 150° and may or may not be equivalent, complimentary or supplementary. The wedge sides 64*a* and 64*b* may be, for example, substantially planar as shown or may be curvilinear along a radial direction.

Figure 6:
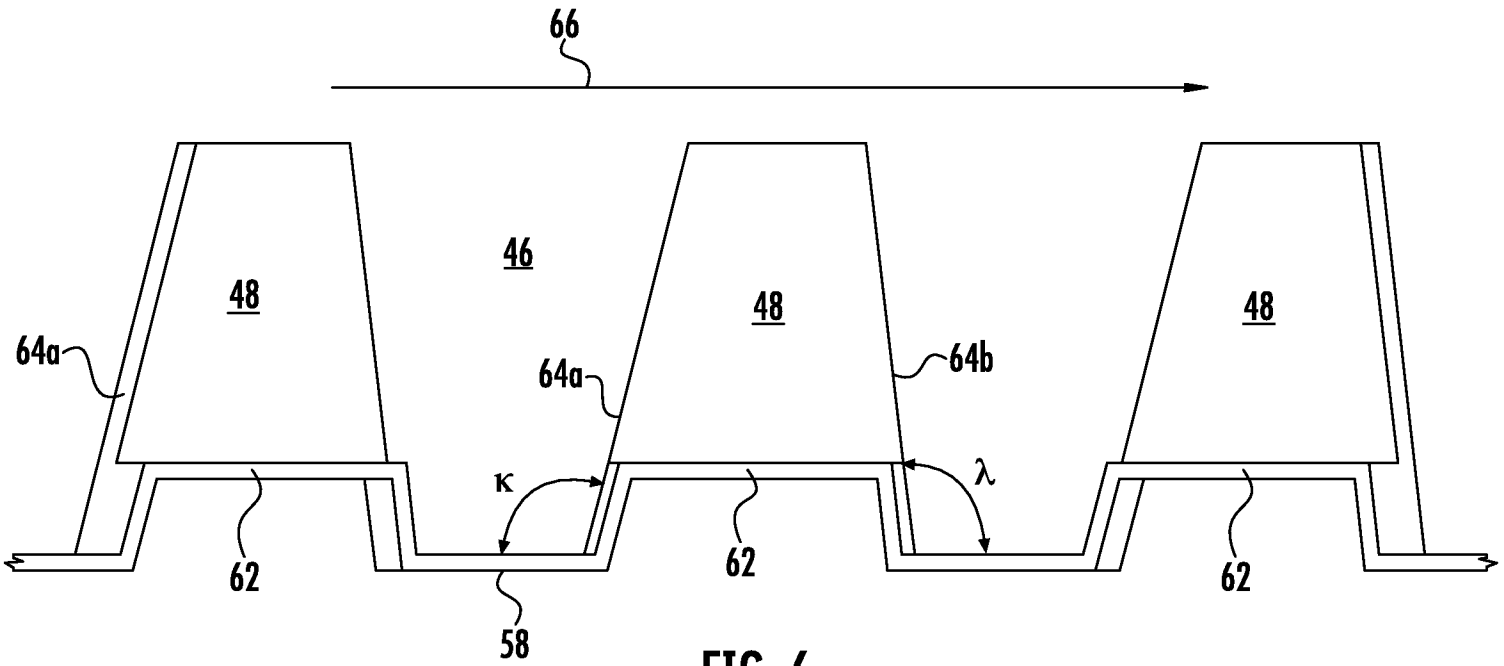
FIG. 6 is a plan view of an interior of an embodiment of a casing.

Referring to FIG. 6, in the axial direction, wedge sides 64*a* and 64*b* form angles K and λ respectively with the upstream casing end 58. In some embodiments, K and λ are between 90° and 150°, while in other embodiments, K and λ may be less than 90°. In embodiments where the casing wedges 48 are co-molded with the casing 22, K and λ greater than 90° are desired to enable the use of straight pull tooling. With other manufacturing methods, however, K and λ of less than 90° may be desirable. Angles K and λ may or may not be equivalent, supplementary or complimentary. Further, while the wedge sides 64*a* and 64*b* are depicted as substantially planar, they may be curvilinear along the axial direction.

Selecting angles α, β, K, and λ and axial and radial steps $S_1$ and $S_2$ as well as gaps $G_F$ and $G_S$ allows a reinjection angle of the recirculation flow 70 and a mass flow of the recirculation flow 70 to be selected and controlled.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A fan assembly comprising:

a shrouded fan rotor including:

a plurality of fan blades rotatable about a central axis of the fan assembly; and a fan shroud extending circumferentially around the fan rotor and secured to the plurality of fan blades, the shroud having an S-shaped cross-section along an axial direction; and a casing disposed circumferentially around the fan shroud defining a radial clearance between the casing and the fan shroud, the casing including a plurality of casing wedges extending from a radially inboard surface of the casing toward the shroud, each casing wedge including a first wedge surface and a second wedge surface defining a radial wedge gap between the first wedge surface and a maximum radius point of the shroud and an axial wedge gap between the second wedge surface and an upstream end of the fan shroud, wherein the second wedge surface is disposed upstream of the upstream end of the fan shroud, wherein circumferentially adjacent casing wedges of the plurality of casing wedges are circumferentially spaced by an opening width.

2. The fan assembly of claim 1, wherein the second wedge surface is coincident with a forward surface of the casing such that the axial wedge gap is defined between a forward casing surface and an upstream end of the fan shroud.

3. The fan assembly of claim 1, wherein the plurality of casing wedges are formed integral with the casing.

4. The fan assembly of claim 1, wherein a ratio of casing wedge width in a circumferential direction to the opening width between adjacent casing wedges is between 0.05 and 2.

5. The fan assembly of claim 1, wherein a ratio of casing wedge width in a circumferential direction to a circumference of the fan shroud is between 0.002 and 0.2.

6. The fan assembly of claim 1, wherein the plurality of casing wedges is not a multiple of the plurality of fan blades.

7. The fan assembly of claim 1, wherein a radial distance of the first wedge surface from an inner casing surface is between one and twenty times the radial wedge gap.

8. The fan assembly of claim 7, wherein the radial distance varies along an axial casing wedge length.

9. The fan assembly of claim 1, wherein an axial distance of the second wedge surface from an upstream end of the casing is between one and twenty times an axial clearance between the fan shroud and the casing.

10. The fan assembly of claim 9, wherein the axial distance varies along a radial direction.

11. The fan assembly of claim 1, wherein an axial casing wedge length is between 25% and 100% of an axial casing length.

12. The fan assembly of claim 1, wherein each of the plurality of casing wedges includes a first radial wedge side and a second radial wedge side extending from an upstream end of the casing.

13. The fan assembly of claim 12, wherein the first radial wedge side of a casing wedge of the plurality of casing wedges and the second radial wedge side of the same casing wedge of the plurality of casing wedges form angles with tangents of a casing inner surface between 30 and 150 degrees.

14. The fan assembly of claim 12, wherein the first radial wedge side of a casing wedge of the plurality of casing wedges and the second radial wedge side of the same casing wedge of the plurality of casing wedges are planar.

15. The fan assembly of claim 12, wherein the first radial wedge side of a casing wedge of the plurality of casing wedges and the second radial wedge of the same casing wedge of the plurality of casing wedges side form angles with the first casing end between 90 and 150 degrees.

16. A casing for an axial flow fan comprising:

a casing inner surface extending circumferentially around a central axis of the fan; and a plurality of casing wedges extending radially inwardly from the casing inner surface, each of the plurality of casing wedges including:

a first wedge surface defining a radial wedge gap between the first wedge surface and a fan rotor; and a second wedge surface defining an axial wedge gap between the second wedge surface and an upstream end of the fan rotor, wherein the second wedge surface is disposed upstream of the upstream end of the fan rotor;

wherein circumferentially adjacent casing wedges of the plurality of casing wedges are circumferentially spaced by an opening width.

17. The casing of claim 16, wherein the second wedge surface of a casing wedge of the plurality of casing wedges is coincident with a forward surface of the casing such that the axial wedge gap exists between the forward casing surface and an upstream end of the fan shroud.

18. The casing of claim 16, wherein the plurality of casing wedges are formed integral with the casing.

19. The casing of claim 16, wherein a ratio of casing wedge width in a circumferential direction to the opening width between adjacent casing wedges is between 0.05 and 2.

20. The casing of claim 16, wherein a radial distance of the first wedge surface of a casing wedge of the plurality of casing wedges from an inner casing surface is between one and twenty times the radial wedge gap.

21. The casing of claim 20, wherein the radial distance varies along an axial casing wedge length.

22. The casing of claim 16, wherein an axial distance of the second wedge surface of a casing wedge of the plurality of casing wedges from an upstream end of the casing is between one and twenty times an axial clearance between the fan shroud and the casing.

23. The casing of claim 22, wherein the axial distance varies along a radial direction.

24. The casing of claim 16, wherein an axial casing wedge length is between 25% and 100% of an axial casing length.

25. The casing of claim 16, wherein each casing wedge includes a first radial wedge side and a second radial wedge side extending from an upstream end of the casing.

26. The casing of claim 25, wherein the first radial wedge side of a casing wedge of the plurality of casing wedges and the second radial wedge side of the same casing wedge of the plurality of casing wedges form angles with tangents of a casing inner surface between 30 and 150 degrees.

27. The casing of claim 25, wherein the first radial wedge side of a casing wedge of the plurality of casing wedges and the second radial wedge side of the same casing wedge of the plurality of casing wedges are planar.

28. The casing of claim 25, wherein the first radial wedge side of a casing wedge of the plurality of casing wedges and the second radial wedge side of the same casing wedge of the plurality of casing wedges form angles with the first casing end between 90 and 150 degrees.

29. A fan assembly comprising:

a shrouded fan rotor including:

a plurality of fan blades extending from a rotor hub and rotatable about a central axis of the fan assembly; and a fan shroud extending circumferentially around the fan rotor and secured to the plurality of fan blades, the shroud having:

a first axially extending annular portion secured to the plurality of fan blades;

a second axially extending annular portion radially outwardly spaced from the first axially extending annular portion; and a third portion connecting the first and second axially extending annular portions; and a casing disposed circumferentially around the fan shroud defining a radial clearance between the casing and the fan shroud, the casing including a plurality of casing wedges extending from a radially inboard surface of the casing toward the shroud, each casing wedge including a first wedge surface and a second wedge surface and defining a radial wedge gap between the first wedge surface and a maximum radius point of the shroud and an axial wedge gap between the second wedge surface and an upstream end of the fan shroud, wherein the second wedge surface is disposed upstream of the upstream end of the fan shroud, wherein circumferentially adjacent casing wedges of the plurality of casing wedges are circumferentially spaced by an opening width.

30. The fan assembly of claim 29, wherein the fan shroud has one of an S-shaped cross-section, a J-shaped cross-section, or a T-shaped cross-section.

31. The fan assembly of claim 29, wherein the second wedge surface is coincident with a forward surface of the casing such that the axial wedge gap exists between a forward casing surface and an upstream end of the fan shroud.

32. The fan assembly of claim 29, wherein the plurality of casing wedges are formed integral with the casing.

33. The fan assembly of claim 29, wherein a ratio of casing wedge width in a circumferential direction to the opening width between adjacent casing wedges is between 0.05 and 2.

34. The fan assembly of claim 29, wherein a ratio of casing wedge width in a circumferential direction to a circumference of the fan shroud is between 0.002 and 0.2.

35. The fan assembly of claim 29, wherein each of the plurality of casing wedges includes a first radial wedge side and a second radial wedge side extending from an upstream end of the casing.

36. The fan assembly of claim 35, wherein the first radial wedge side of a casing wedge of the plurality of casing wedges and the second radial wedge side of the same casing wedge of the plurality of casing wedges form angles with tangents of a casing inner surface between 30 and 150 degrees.

37. The fan assembly of claim 35, wherein the first radial wedge side of a casing wedge of the plurality of casing wedges and the second radial wedge side of the same casing wedge of the plurality of casing wedges are planar.

38. The fan assembly of claim 35, wherein the first radial wedge side of a casing wedge of the plurality of casing wedges and the second radial wedge side of the same casing wedge of the plurality of casing wedges form angles with the first casing end between 90 and 150 degrees.

* * * * *